US010068586B2

(12) United States Patent
Braasch

(10) Patent No.: US 10,068,586 B2
(45) Date of Patent: Sep. 4, 2018

(54) BINAURALLY INTEGRATED CROSS-CORRELATION AUTO-CORRELATION MECHANISM

(71) Applicant: Rensselaer Polytechnic Institute, Troy, NY (US)

(72) Inventor: Jonas Braasch, Latham, NY (US)

(73) Assignee: Rensselaer Polytechnic Institute, Troy, NY (US)

( * ) Notice: Subject to any disclaimer, the term of this patent is extended or adjusted under 35 U.S.C. 154(b) by 0 days.

(21) Appl. No.: 15/500,230

(22) PCT Filed: Aug. 14, 2015

(86) PCT No.: PCT/US2015/045239
§ 371 (c)(1),
(2) Date: Jan. 30, 2017

(87) PCT Pub. No.: WO2016/025812
PCT Pub. Date: Feb. 18, 2016

(65) Prior Publication Data

US 2017/0243597 A1 Aug. 24, 2017

Related U.S. Application Data

(60) Provisional application No. 62/037,135, filed on Aug. 14, 2014.

(51) Int. Cl.
*G10L 21/0308* (2013.01)
*G10L 21/0272* (2013.01)
(Continued)

(52) U.S. Cl.
CPC ..... *G10L 21/0264* (2013.01); *G10L 21/0308* (2013.01); *H04R 25/552* (2013.01);
(Continued)

(58) Field of Classification Search
CPC ..... G10L 21/0264; G10L 21/0308; G10L 2021/02082; H04S 1/00; H04S 7/303; H04S 2420/01
See application file for complete search history.

(56) References Cited

U.S. PATENT DOCUMENTS 6,466,913 B1 10/2002 Yasuda et al.
8,213,622 B2 7/2012 Sakurai et al.
(Continued)

FOREIGN PATENT DOCUMENTS

EP 1600791 B1 11/2005
WO 03/090208 A1 10/2003

OTHER PUBLICATIONS

International Search Report and Written Opinion for PCT/US2015/045239 dated Nov. 6, 2015.
(Continued)

*Primary Examiner* — Sonia Gay
(74) *Attorney, Agent, or Firm* — Hoffman Warnick LLC

(57) ABSTRACT

A sound processing system, method and program product for estimating parameters from binaural audio data. A system is provided having: a system for inputting binaural audio; and a binaural signal analyzer (BICAM) that: performs autocorrelation on both the first channel and second channel to generate a pair of autocorrelation functions; performs a first layer cross-correlation between the first channel and second channel to generate a first layer cross-correlation function; removes the center peak from the first layer cross-correlation function and a selected autocorrelation function to create a modified pair; performs a second layer cross-correlation between the modified pair to determine a temporal mismatch; generates a resulting function by replacing the first layer cross correlation function with the selected autocorrelation function using the temporal mismatch; and utilizes the resulting function to determine ITD
(Continued)

parameters and interaural level difference ILD parameters of the direct sound components and reflected sound components.

18 Claims, 14 Drawing Sheets

(51) Int. Cl.

| | |
|---|---|
| ***G10L 21/0208*** | (2013.01) |
| ***H04S 1/00*** | (2006.01) |
| ***H04S 7/00*** | (2006.01) |
| ***H04R 25/00*** | (2006.01) |
| ***G10L 21/0264*** | (2013.01) |

(52) U.S. Cl.
CPC ..... *H04S 1/00* (2013.01); *H04S 7/303* (2013.01); *G10L 21/0272* (2013.01); *G10L 2021/02082* (2013.01); *H04R 2225/43* (2013.01); *H04S 2420/01* (2013.01)

(56) References Cited

U.S. PATENT DOCUMENTS

| | | | | |
|---|---|---|---|---|
| 8,761,410 | B1 | 6/2014 | Avendano et al. | |
| 2002/0183947 | A1 | 12/2002 | Ando et al. | |
| 2005/0276419 | A1 | 12/2005 | Eggert et al. | |
| 2007/0185708 | A1 | 8/2007 | Manjunath et al. | |
| 2008/0056517 | A1 | 3/2008 | Algazi et al. | |
| 2009/0198356 | A1* | 8/2009 | Goodwin | G10L 19/008 700/94 |
| 2012/0051553 | A1* | 3/2012 | Sohn | G10L 21/0208 381/71.1 |
| 2012/0070008 | A1* | 3/2012 | Sohn | H04R 25/356 381/23.1 |
| 2015/0334500 | A1* | 11/2015 | Mieth | H04L 65/601 381/17 |

OTHER PUBLICATIONS

Braasch et al., "The precedence effect for noise bursts of different bandwidths. II. Comparison of model algorithms," Acoust. Sci & Tech. 24, 293-303.

Ma, Ning et al.; "A hearing-inspired approach for distant-microphone speech recognition in the presence of multiple sources"; Computer Speech and Language; vol. 27; No. 3; Sep. 16, 2012; pp. 820-836.

Soeta, Yoshiharu et al.; "Auditory evoked magnetic fields in relation to interaural time delay and interaural correlation"; vol. 220; Issues 1-2; Oct. 2006; pp. 3; Printed Jun. 1, 2018; <https://www.sciencedirect.com/science/artilce/pii/S0378595506001948>.

European Search Report dated Jan. 2, 2018 for EP Application No. 15831928.5; pp. 6.

* cited by examiner

BINAURALLY INTEGRATED CROSS-CORRELATION AUTO-CORRELATION MECHANISM

This invention was made with government support under contract numbers 1229391 and 1320059 awarded by the National Science Foundation. The government has certain rights in the invention.

TECHNICAL FIELD

The subject matter of this invention relates to the localization and separation of sound sources in a reverberant field, and more particularly to a sound localization system that separates direct and reflected sound components from binaural audio data using a second-layer cross-correlation process on top of a first layer autocorrelation/cross-correlation process.

BACKGROUND

Binaural hearing, along with frequency cues, lets humans and other animals determine the localization, i.e., direction and origin, of sounds. The localization of sound sources in a reverberant field, such as a room, using audio equipment and signal processing however remains an ongoing technical problem. Sound localization could potentially have application in many different fields, including, e.g., robotics, entertainment, hearing aids, military, etc.

A related problem area involves sound separation in which sounds from different sources are segregated using audio equipment and signal processing.

Binaural signal processing, which uses two microphones to capture sounds, has showed some promise of resolving issues with sound localization and separation. However, due to the complex nature of sounds reverberating within a typical field, current approaches have yet to provide a highly effective solution.

SUMMARY

The disclosed solution provides a binaural sound processing system that employs a BICAM (binaural cross-correlation autocorrelation mechanism) process for separating direct and reflected sound components from binaural audio data.

In a first aspect, the invention provides a sound processing system for estimating parameters from binaural audio data, comprising: (a) a system for inputting binaural audio data having a first channel and a second channel captured from a spatial sound field using at least two microphones; and (b) a binaural signal analyzer for separating direct sound components from reflected sound components, wherein the binaural signal analyzer includes a mechanism (BICAM) that: performs an autocorrelation on both the first channel and second channel to generate a pair of autocorrelation functions; performs a first layer cross-correlation between the first channel and second channel to generate a first layer cross-correlation function; removes the center peak from the first layer cross-correlation function and a selected autocorrelation function to create a modified pair; performs a second layer cross-correlation between the modified pair to determine a temporal mismatch; generates a resulting function by replacing the first layer cross correlation function with the selected autocorrelation function using the temporal mismatch such that the center peak of the selected autocorrelation function matches the temporal position of the center peak of the first layer cross correlation function; and utilizing the resulting function to determine interaural time difference (ITD) parameters and interaural level difference (ILD) parameters of the direct sound components and reflected sound components.

In a second aspect, the invention provides a computerized method for estimating parameters from binaural audio data having a first channel and a second channel captured from a spatial sound field using at least two microphones, the method comprising: performing an autocorrelation on both the first channel and second channel to generate a pair of autocorrelation functions; performing a first layer cross-correlation between the first channel and second channel to generate a first layer cross-correlation function; removing the center peak from the first layer cross-correlation function and a selected autocorrelation function to create a modified pair; performing a second layer cross-correlation between the modified pair to determine a temporal mismatch; generating a resulting function by replacing the first layer cross correlation function with the selected autocorrelation function using the temporal mismatch such that the center peak of the selected autocorrelation function matches the temporal position of the center peak of the first layer cross correlation function; and utilizing the resulting function to determine interaural time difference (ITD) parameters and interaural level difference (ILD) parameters of the direct sound components and reflected sound components.

In a third aspect, the invention provides a computer program product stored on a computer readable medium, which when executed by a computing system estimates parameters from binaural audio data having a first channel and a second channel captured from a spatial sound field using at least two microphones, the program product comprising: program code for performing an autocorrelation on both the first channel and second channel to generate a pair of autocorrelation functions; program code for performing a first layer cross-correlation between the first channel and second channel to generate a first layer cross-correlation function; program code for removing the center peak from the first layer cross-correlation function and a selected autocorrelation function to create a modified pair; program code for performing a second layer cross-correlation between the modified pair to determine a temporal mismatch; program code for generating a resulting function by replacing the first layer cross correlation function with the selected autocorrelation function using the temporal mismatch such that the center peak of the selected autocorrelation function matches the temporal position of the center peak of the first layer cross correlation function; and program code for utilizing the resulting function to determine interaural time difference (ITD) parameters and interaural level difference (ILD) parameters of the direct sound components and reflected sound components.

BRIEF DESCRIPTION OF THE DRAWINGS

These and other features of this invention will be more readily understood from the following detailed description of the various aspects of the invention taken in conjunction with the accompanying drawings in which.

Figure 1:
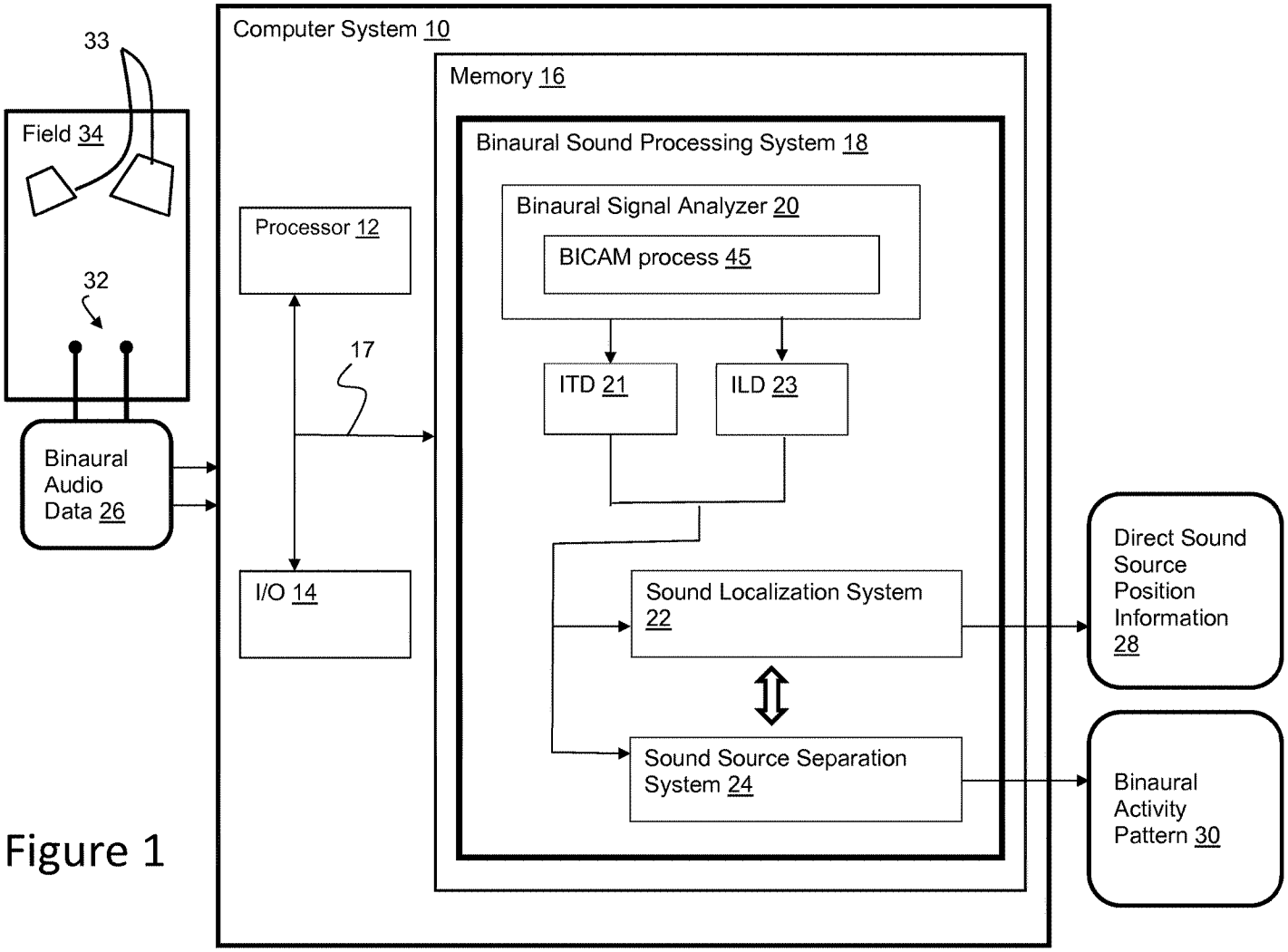
FIG. 1 depicts a computer system having a sound processing system according to embodiments.

The drawings are not necessarily to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION

As shown in an illustrative embodiment in FIG. 1, the present invention may be implemented with a computer system 10 having a binaural sound processing system 18 that processes binaural audio data 26 and generates direct sound source position information 28 and/or binaural activity pattern information 30. Binaural audio data 26 is captured via an array of microphones 32 (e.g., two or more) from one or more sound sources 33 within a spatial sound field 34, namely an acoustical enclosure such as a room, auditorium, area, etc. Spatial sound field 34 may comprise any space that is subject to sound reverberations.

Binaural sound processing system 18 generally includes a binaural signal analyzer 20 that employs a BICAM (binaural cross-correlation autocorrelation mechanism) process 45, for processing binaural audio data 26 to generate interaural time difference (ITD) 21 and interaural level difference (ILD) 23 information; a sound localization system 22 that utilizes the ITD 21 and ILD 23 information to determined direct sound source position information 28; and a sound source separation system 24 that utilizes the ITD 21 and ILD 23 information to generate a binaural activity pattern 30 that, e.g., segregates sound sources within the field 34. Sound source localization system 22 and sound source separation system 24 may also be utilized in an iterative manner, as described herein. Although described generally as processing binaural audio data 26, the described systems and methods may be applied to any multichannel audio data.

In general, the pathway between a sound source 33 and a receiver (e.g., microphones 32) can be described mathematically by an impulse response. In an anechoic environment, the impulse response consists of a single peak, representing the direct path between the sound source and the receiver. In typical natural conditions, the peak for the direct path (representing the direct sound source) and additional peaks occur with a temporal delay to the direct sound peak representing sound that is reflected off walls, the floor and other physical boundaries. If reflections occur, it is often referred to as a room impulse response. Early reflections are typically distinct in time (and thus can be represented by a single peak for each reflection), but late reflections are of diffuse character and smear out to a continuous, noise-like exponentially decaying curve, the so-called late reverberation. This phenomenon is observed, because the in a room-type acoustical enclosure there is nearly an unlimited number of combinations the reflections can bounce of the various walls.

An impulse response between a sound source 33 and multiple receivers is called a multi-channel impulse response. The pathway between a sound source and the two ears of a human head (or a binaural manikin with two microphones placed the manikin's ear entrances) is a special case of a multi-channel impulse response, the so-called binaural room impulse response. One interesting aspect of a multi-channel room impulse response is that the spatial positions of the direct sound signal and the reflections can be calculated from the time (and or level differences between the multiple receivers) the direct sound source and the reflections arrive at the receivers (e.g., microphones 32). In case of a binaural room impulse response, the spatial positions (azimuth, elevation and distance to each other), can be determined from interaural time differences (ITD) and interaural level differences (ILD) and the delays between each reflections from the direct sound.

Figure 2:
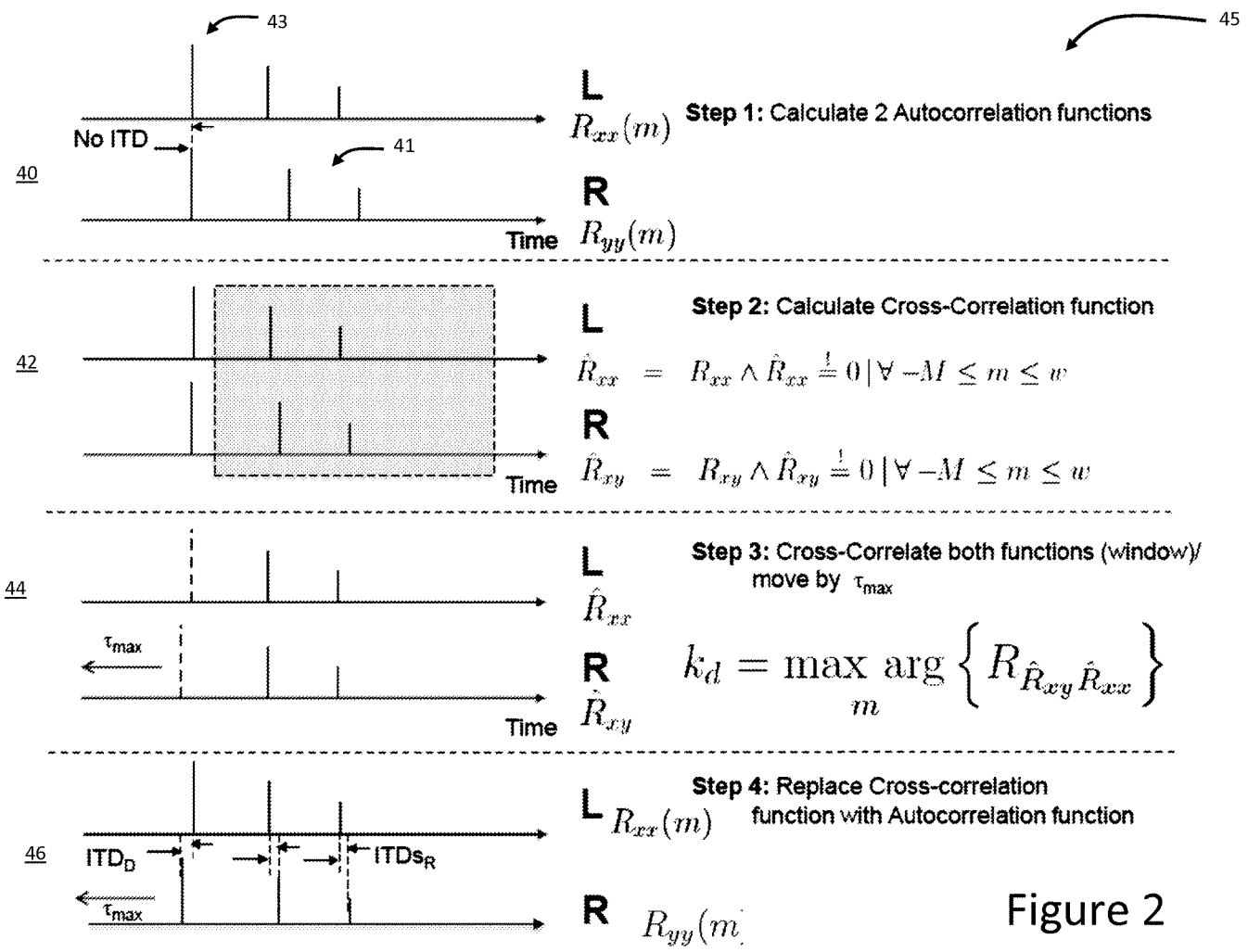
FIG. 2 depicts an illustrative series of signals showing the BICAM process according to embodiments.

FIG. 2 depicts a series of time based audio sequence pairs 40, 42, 44, and 46 that show an illustrative example and related methodology for implementing the BICAM process 45. The first pair of sequences 40 shows the left and right autocorrelation signals of binaural audio data 26. It can be seen that the right reverberation signals 41 slightly lag the left signals. The first step of the BICAM process 45 is to calculate autocorrelation functions $R_{xx}(m)$ and $R_{yy}(m)$ for the left and right signals. As can be seen, no interaural time difference (ITD) appears between the center (i.e., main) peaks of the left and right signals even though the direct signal is lateralized with an ITD. Next, as shown in 42, a cross-correlation function is calculated and at 44, a selected one of the autocorrelation functions is cross-correlated with the correlation function. Finally, at 46, the cross-correlation function is replaced with the autocorrelation function. This process is described in further detail as steps 1-4.

Step 1: The BICAM process 45 first determines the autocorrelation functions for the left and right ear signals (i.e., channels) 40. The side peaks 41 of the autocorrelation functions contain information about the location and amplitudes of early room reflections (since the autocorrelation function is symmetrical only the right side of the function is shown and the center peak 43 is the leftmost peak). Side peaks 41 can also occur through the periodicity of the signal, but these can be separated from typical room reflections, because the latter ones occur at different times for the left and right ear signals, which the periodicity-specific peaks have the same location in time for the left and right ear signals. The problem with the left and right ear autocorrelation functions ($R_{xx}$ and $R_{yy}$) is that they have no information about their time alignment (internal delay) to each other. By definition, the center peak 43 of the autocorrelation functions (which mainly represents the direct source signal) is located in the center at 0's.

Step 2: In order to align both autocorrelation functions such that the main center peaks of the left and right ear autocorrelation functions show the interaural time difference (ITD) of the direct sound signal (which determines the sound source's azimuth location), step 2 makes use of the fact that the positions of the reflections at one side (the left ear signal in this example) are fixed for the direct signal of the left ear and the direct signal of the right ear. Process 45 takes the autocorrelation function of the left ear to compare the positions of the room reflections to the direct sound signal of the left ear. Then the cross-correlation function is taken between the left and right ears signals to compare the positions of the room reflections to the direct sound signal of the right ear. The result is that the side peaks of the autocorrelation function and the cross-correlation function have the same positions (signals 44).

Step 3: The temporal mismatch is calculated using another cross-correlation function $R_{Rxx/Rxy}$, which is termed the "second-layer cross-correlation function." In order to make this work, the influence of the main peak is eliminated by windowing it out or reducing its peak to zero. In this case, step 44 only uses the part of the auto-/cross correlation functions on the right of the y-axis (i.e., the left side channel information is removed); however both sides could be used with a modified algorithm as long as the main peak is not weighed into the calculation. The location of the main peak of the second-layer cross-correlation function $k_d$ determines the time shift $\tau_d$ the cross-correlation function has to be shifted to align the side peaks of the cross-correlation function to the autocorrelation function.

Step 4: The (first-layer) cross-correlation function $R_{xy}$ is returned back to the autocorrelation function $R_{yy}$ such that the main peak of the autocorrelation function matches the temporal position of the main peak of the cross-correlation function $R_{xy}$. The interaural time differences (ITD) for the direct signal and the reflections can now be determined individually from this function. A running interaural cross-correlation function can be performed over both time aligned autocorrelation functions to establish a binaural activity pattern (see, e.g., FIG. 17).

A binaural activity pattern is a two-dimensional plot that shows the temporal time course on one axis, the spatial locations of the direct sound source and each reflection on a second axis (e.g., via the ITD). The strength (amplitude) is typically shown on a third axis, coded in color or a combination of both as shown in FIG. 17.

Figure 17:
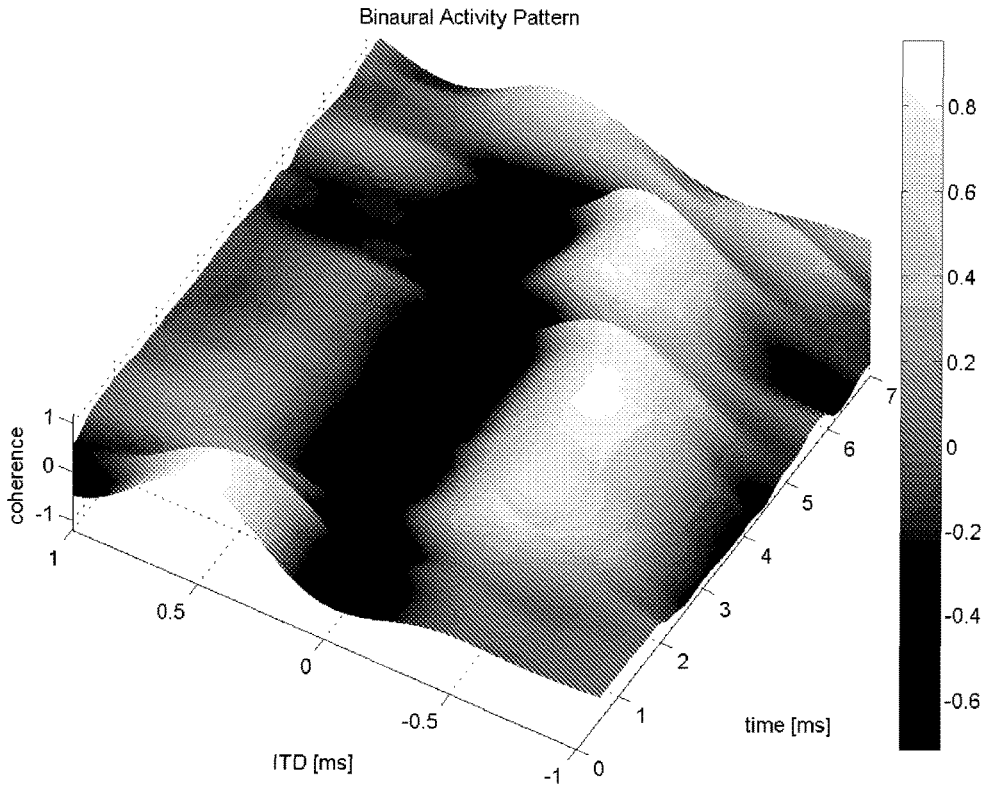
FIG. 17 depicts a binaural activity pattern according to embodiments.

In the binaural activity pattern shown in FIG. 17, the HRTF (head-related transfer function) for the direct sound, a noise signal, was set at −45 degrees azimuth, and the azimuth angles of the reflections were 45 degrees and 25 degrees azimuth. The inter-stimulus intervals (ISIs) between the direct sound and the two reflections were 4 and 6 ms. The first reflection had an amplitude of 0.8 compared to the direct signal (before both signals were filtered with the HRTFs). The amplitude of the second reflection was 0.4 compared to the direct signal. The model estimates the position of the direct sound $k_d$ at −21 taps, compared to −20 taps found for the direct HRTF analysis. The ITD for the reflection was estimated to 20 taps compared to 20 taps found in the direct HRTF analysis. Consequently, the BICAM process predicted the direction of both signals fairly accurately.

A further feature of the BICAM process 45 is that is can be used to estimate a multi-channel room impulse response from a running, reverberated signal captured at multiple receivers without a priori knowledge of the sound close to the sound source. The extracted information can be used: (1) to estimate the physical location of a sound source focusing on the localization of the direct sound signal and avoiding that the information from the physical energy of the reflections contribute to errors; and (2) to determine the positions, delays and amplitude of the reflections in additional to the information about the direct sound source, for example to understand the acoustics of a room or to use this information to filter out reflection for an improved sound quality.

The following provides a simple direct sound/reflection paradigm to explain the BICAM process 45 in further detail. A (normalized) interaural cross-correlation (ICC) algorithm is typically used in binaural models to estimate the sound source's interaural time differences (ITD) as follows:

$$\Psi_{yt,r}(t',\tau)=\frac{\int_{t=t'}^{t'+\Delta t} y_t(t-\tau/2)\cdot y_r(t+\tau/2)dt}{\sqrt{\int_{t=t'}^{t'+\Delta t} y_t^2(t)dt\cdot\int_{t=t'}^{t'+\Delta t} y_\tau^2(t)dt}}, \quad (1)$$

with time t, the internal delay $\tau$, and the left and right ear signals $y_l$ and $y_r$. The variable t' is the start time of the analysis window and $\Delta\tau$ its duration. Estimating the interaural time difference of the direct source in presence of a reflection is difficult, because the ICC mechanism extracts both the ITD of the direct sound as well the ITD of the reflection. Typically, the cross-correlation peaks of the direct sound and its reflection overlap to form a single peak; therefore the ITDs can no longer be separated using their individual peak positions. Even when these two peaks are separated enough to be distinct, the ICC mechanism cannot resolve which peak belongs to the direct sound and which to the reflection, because the ICC is a symmetrical process and does not preserve causality.

In a prior approach, the ITD of the direct sound was extracted in a three stage process: First, autocorrelation was applied to the left and right channels to determine the lead/lag delay and amplitude ratio. The determination of the lead/lag amplitude ratio was especially difficult, because the auto-correlation symmetry impedes any straightforward manner the determination of whether the lead or the lag has the higher amplitude. Using the extracted parameters, a filter was applied to remove the lag. The ITD of the lead was then computed from the filtered signal using an interaural cross-correlation model.

The auto-correlation (AC) process allows the determination of the delay T between the direct sound and the reflection quite easily:

$$s_{t1}(t)=s_{d1}(t)+s_{r1}(t)=s_{d1}(t)+r_1\cdot s_{d1}(t-T), \quad (2)$$

with the lead $s_d(t)$ and the lag $s_r(t)$, the delay time T, and the Lag-to-Lead Amplitude Ratio (LLAR) r, which is treated as a frequency-independent, phase-shift-less reflection coefficient. The index 1 denotes the left channel. The auto-correlation can also be applied to the right signal:

$$s_{l2}(t)=s_{d2}(t)+s_{r2}(t)=s_{d1}(t)+r_2 \cdot s_{d2}(t-T), \quad (3)$$

Figure 3:
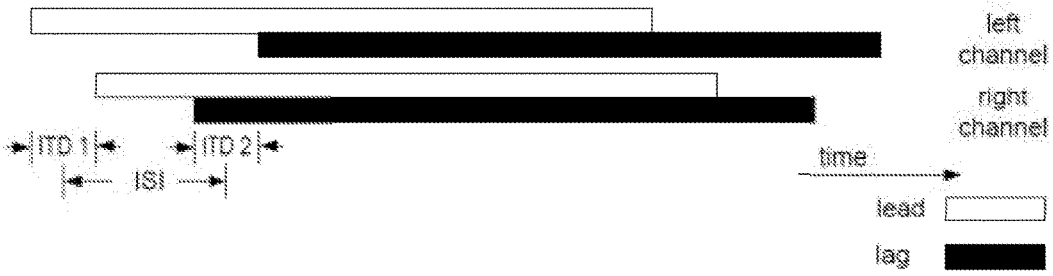
FIG. 3 depicts an illustrative lead and lag delay for binaural audio data according to embodiments.

The problem for the ITD calculation is that the autocorrelation functions for the left and right channels are not temporally aligned. While it is possible to determine the lead/lag delay for both channels (which will typically differ because of their different ITDs, see FIG. 3), the ACs will not indicate how the lead and lag are interaurally aligned.

The approach provided by BICAM process 45 is to use the reflected signal in a selected channel (e.g., the left channel) as a steady reference point and then to (i) compute the delay between the ipsilateral direct sound and the reflection $T_{(d1-r1)}$ using the autocorrelation method and to (ii) calculate the delay between the contralateral direct sound and the reflection $T_{(d2-r1)}$ using the interaural cross-correlation method. The ITD can then be determined by subtracting both values:

$$\mathrm{ITD}_d=T_{(d2-r1)}-T_{(d1-r1)} \quad (4)$$

Alternatively, the direct sound's ITD can be estimated by switching the channels:

$$\mathrm{ITD}_{d*}=T_{(d2-r2)}-T_{(d1-r2)} \quad (5)$$

The congruency between both values can be used to measure the quality of the cue. The same method can be used to determine the ITD of the reflection:

$$\mathrm{ITD}_r=T_{(r2-d1)}-T_{(r1-d1)} \quad (6)$$

Once again, the direct sound's ITD can be estimated by switching the channels:

$$\mathrm{ITD}_{r*}=T_{(r2-d2)}-T_{(r1-d2)} \quad (7)$$

This approach fundamentally differs from previous models, which focused on suppressing the information of the reflections to extract the cues from the direct sound source. The BICAM process 45 utilized here better reflects human perception, because the auditory system can extract information from early reflections and the reverberant field to judge the quality of an acoustical enclosure. Even though humans might not have direct cognitive access to the reflection pattern, they are very good at classifying rooms based on these patterns.

Figure 4:
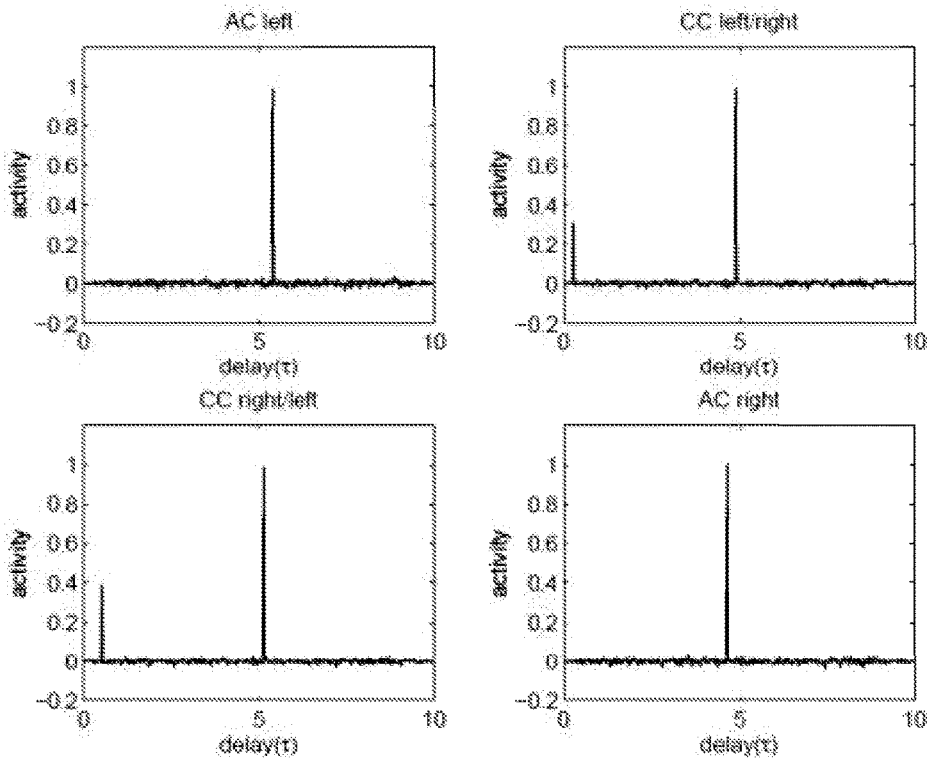
FIG. 4 shows examples of the two autocorrelation functions and the two cross-correlation functions to compute ITDs according to embodiments.

FIG. 4 shows examples of the two autocorrelation functions and the two cross-correlation functions to compute the ITDs using a 1-s white noise burst. In this example, the direct sound has an ITD of 0.25 ms and the reflection an ITD of −0.5 ms. The delay between the reflection and direct sound is 5 ms. The direct sound amplitude is 1.0, while the reflection has an amplitude of 0.8. Using the aforementioned method, the following values were calculated accurately: $\mathrm{ITD}_d$=0.25 ms, $\mathrm{ITD}_{d*}$=0.25 ms, $\mathrm{ITD}_r$=−0.5 ms, $\mathrm{ITD}_{r*}$=−0.5 ms.

Interaural level differences (ILDs) are calculated in a similar way by comparing the peak amplitudes of the corresponding side peaks a. The ILD for the direct sound is calculated as:

$$\mathrm{ILD}_d=20\cdot\log_{10}=a_{(d2/r1)}/a_{(d1/r2)}, \quad (8)$$

or the alternative:

$$\mathrm{ILD}_{d*}=20\cdot\log_{10}=a_{(d2/r2)}/a_{(d1/r2)}, \quad (9)$$

Similarly, the ILDs of the reflection can be calculated two ways as:

$$\mathrm{ILD}r=20\cdot\log_{10}=a_{(d2/r1)}/a_{(d2/r2)}, \quad (10)$$

or:

$$\mathrm{ILD}r=20\cdot\log_{10}=a_{(d2/r1)}/a_{(d2/r2)}, \quad (11)$$

Figure 5:
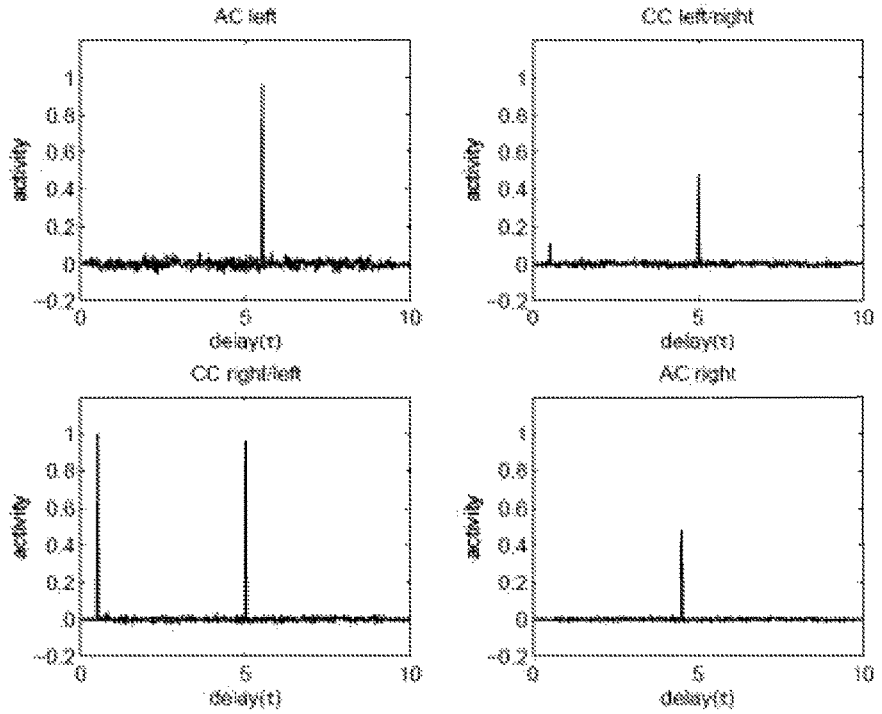
FIG. 5 depicts examples of the two autocorrelation functions and the two cross-correlation functions to compute ITDs to demonstrate the Haas Effect, where the amplitude of the reflection exceeds the amplitude of the direct sound, according to embodiments.

The second example contains a reflection with an interaural level difference of 6 dB. This time, the lag amplitude is higher than the lead amplitude. The ability of the auditory system to localize the direct sound position in this case is called the Haas Effect. FIG. 5 shows the autocorrelation/cross correlation functions for this condition. The model extracted the following parameters: $\mathrm{ITD}_d$=0.5 ms, $\mathrm{ITD}_r$=−0.5 ms, $\mathrm{ILD}_d$=−0.2028 dB, $\mathrm{ILD}_{d*}$=−0.3675 dB, $\mathrm{ILD}_r$=−6.1431 dB, $\mathrm{ILD}_{r*}$=−6.3078 dB.

One advantage of this approach is that it can handle multiple reflections as long as the corresponding side peaks for the left and right channels can be identified. One simple mechanism to identify side peaks is to look for the highest side peaks in each channel to extract the parameters for the first reflection and then look for the next highest side peaks that has a greater delay than the first side peak to determine the parameters for the second reflection. This approach is justifiable because room reflections typically decrease in amplitude with the delay from the direct sound source due to the inverse-square law of sound propagation. Alternative approaches may be used to handle more complex reflection patterns including recordings obtained in physical spaces.

Figure 6:
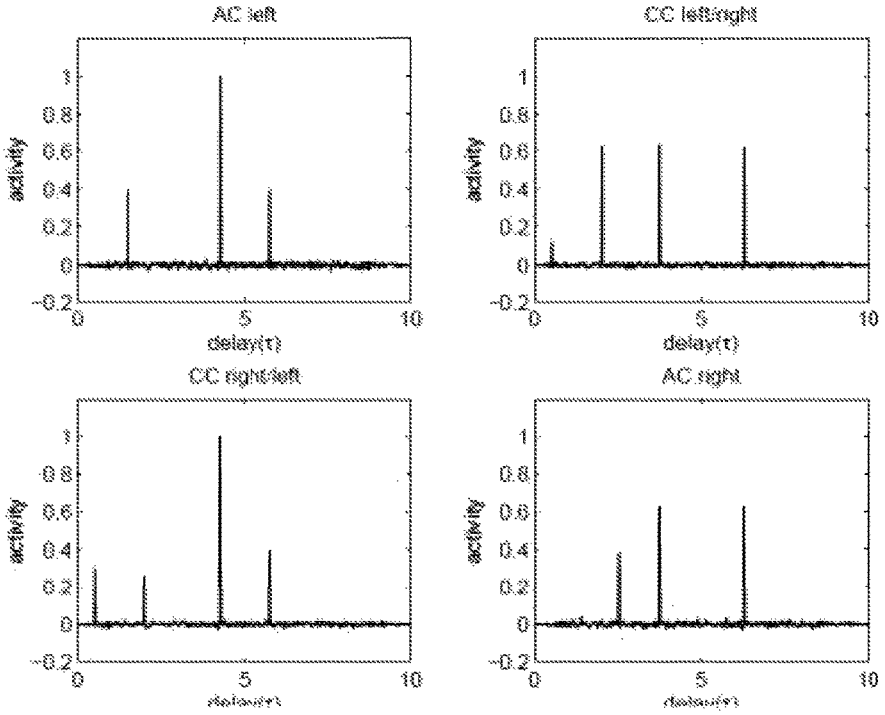
FIG. 6 shows the results for a direct sound source and two reflections according to embodiments.

FIG. 6 shows the results for a direct sound source and two reflections. The following parameters were selected—Direct Sound Source: 0.0 ms-ITD, 0-dB ILD, Amplitude of 1; First Reflection: −0.5-ms ITD, 4-dB ILD, Amplitude of 0.8, 4-ms lead/lag delay; Second Reflection: 0.5-ms ITD, −4-dB ILD, Amplitude of 0.5, 6-ms lead/lag delay. The BICAM process 45 estimated these parameters as follows: 0.0 (0.0)-ms ITD, 0.1011(0.0089)-dB ILD; First Reflection: −0.5 (−0.5)-ms ITD, 3.9612 (4.0534)-dB ILD; Second Reflection: 0.5-ms ITD, −3.8841 (−4.0234)-dB ILD. (Results for the alternative '*'-denoted methods are given in parentheses.)

Figure 7:
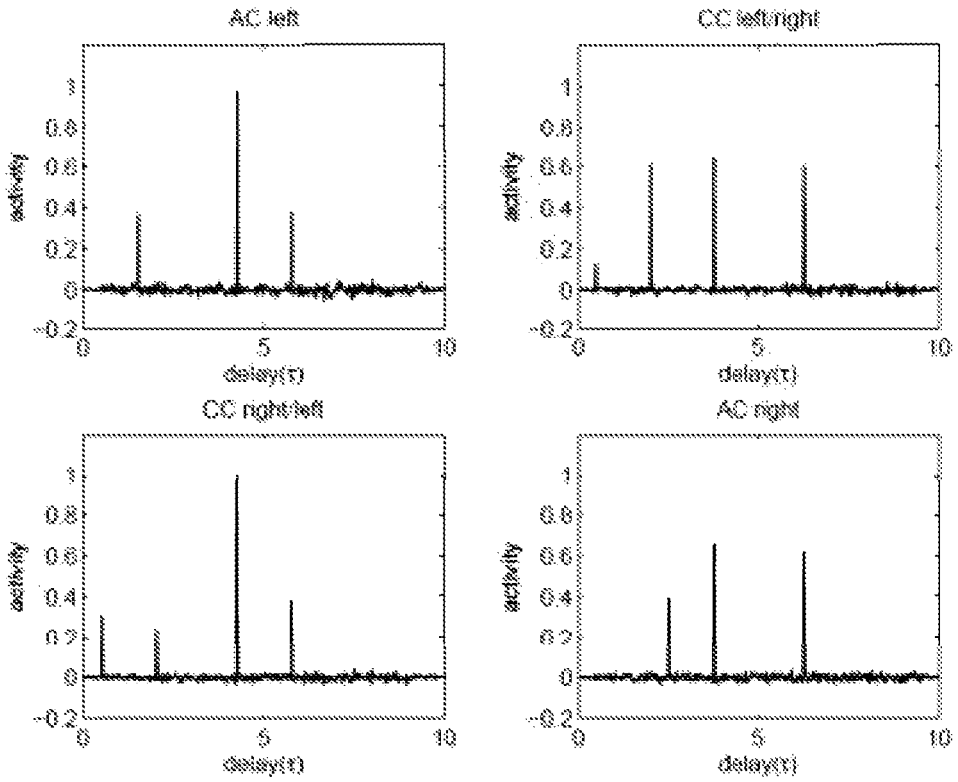
FIG. 7 depicts the results of FIG. 6 with a diffuse reverberation tail was added to the direct sound source and the two reflections. according to embodiments.

In the previous example shown in FIG. 7, a diffuse reverberation tail was added to the direct sound source and the two reflections. The onset delay of the reverberation tail was set to 10 ms. The reverberation time was 0.5 seconds with a direct-to-reverberation-tail energy ratio of 6 dB. Aside from the additional reverberation tail, the stimulus parameters were kept the same as the previous example. The BICAM process 45 extracted the following parameters: 0.0 (0.0)-ms ITD, −0.1324 (−0.2499)-dB ILD; First Reflection: −0.5 (−0.5)-ms ITD, 3.5530 (3.6705)-dB ILD; Second Reflection: 0.5-ms ITD, 4.0707 (−4.2875)-dB ILD (Again, the results for the alternative '*'-denoted methods are given in parentheses.).

As previously noted, the estimation of the direct sound source and reflection amplitudes was difficult using previous approaches. For example, in prior models, the amplitudes were needed to calculate the lag-removal filter as an intermediate step to calculate the ITDs. Since the present approach can estimate the ITDs without prior knowledge of the signal amplitudes, a better algorithm, which requires prior knowledge of the ITDs, can be used to calculate the signal component amplitudes. Aside from its unambiguous performance, the approach is also an improvement because it can handle multiple reflections. The amplitude estimation builds on an extended Equalization/Cancellation EC model that detects a masked signal, and calculates a matrix of difference terms for various combinations of ITD/ILD values. Such an approach was used in detecting a signal by finding a trough in the matrix.

A similar approach can be used to estimate the amplitudes of the signal components. Using the EC approach and known ILD/ITD values, the specific signal-component is eliminated from the mix. The signal-component amplitude can then be calculated from the difference of the mixed signal and the mixed signal without the eliminated component. This process can be repeated for all signal-components. In order to calculate accurate amplitude values, the square root terms have to be used, because the subtraction of the right from the left channel not only eliminates the signal component, but also adds the other components. Since the other components are decorrelated, the added amplitude is 3-dB per doubled amplitude, whereas the elimination of the signal component is a process using two correlated signals that goes with 6-dB per doubled amplitude.

Figure 8:
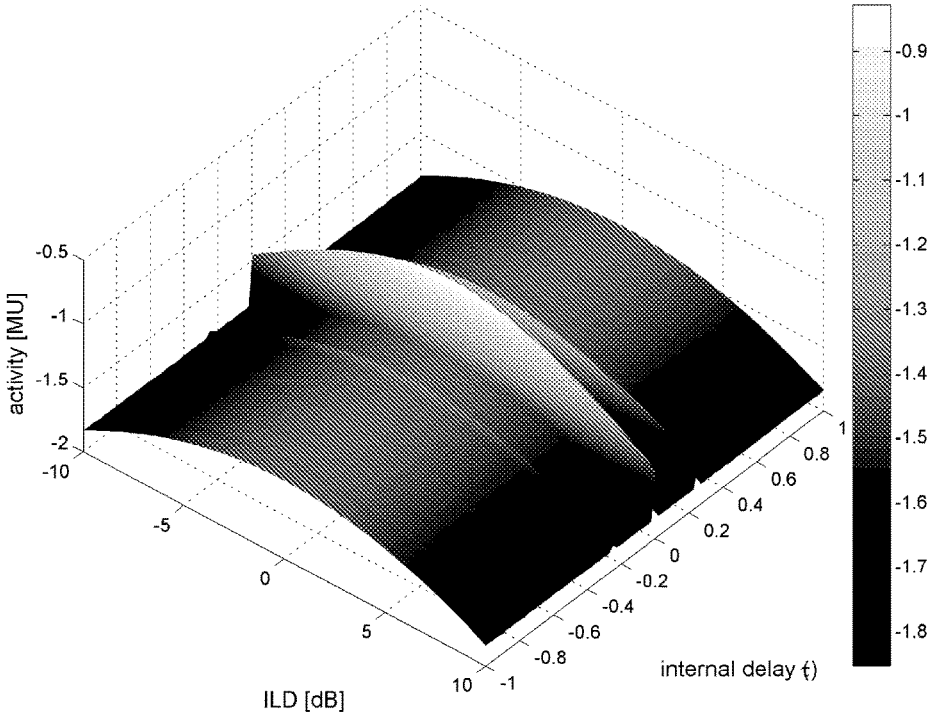
FIG. 8 depicts the result of an EC difference-term matrix. according to embodiments.
Figure 9:
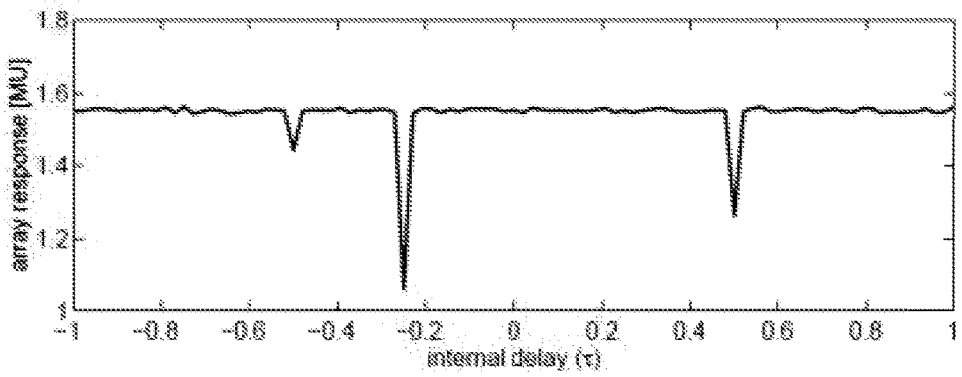
FIG. 9 depicts ITD locations of the direct sound, first reflection, and second reflection according to embodiments.

FIG. 8 shows the result of the EC difference-term matrix. Note that the matrix was plotted for the negative difference matrix, so the troughs show up as peaks, which are easier to visualize. The three local peaks appear as expected at the combined ITD/ILD values for each of the three signal components: direct sound, first reflection, and second reflection. The measured trough values for these components were: 1.0590, 1.4395, and, which are subtracted from the median of all measured values along the ILD axis, which was 1.5502 (see FIG. 9). This is done to calculate the relative amplitudes: ad=0.4459, ar1=0.3406, ar2=0.2135 or ar1/ad=0.7638, ar2/ad=0.4788, which are very close to the set values of 0.8 and 0.5 for ar1/ad and ar2/ad respectively.

The following code segment provides an illustrative mechanism to eliminate side peaks of cross-correlation/auto-correlation functions that result from cross terms and are not attributed to an individual reflection, but could be mistaken for these and provide misleading results. The process takes advantage of the fact that the cross terms appear as difference terms of the corresponding side peaks. For example, two reflections at lead/lag delays of 400 and 600 taps will induce a cross term at 200 taps. Using this information, the algorithm recursively eliminates cross terms starting from the highest delays:

```
Y=xcorr(y,y,800);                    % determine auto-correlation for signal y
b=length(Y);
M=zeros(b,b);                        % cross-term computation matrix
a=(b+1)./2;
Y=Y(a:b);                            % extract right side of autocorrelation function
Y(1)=0;                              % eliminate main peak

for n=b:-1:2                         % start from highest to lowest coefficients
    M(:,n)=Y(n).*Y;                  % compute potential cross terms ...
    maxi=max(M(n-1:-1:2,n));         % ... and find the biggest maximum
    if maxi>threshold   % cancel cross term if maximum exceeds set threshold
        Y(2:ceil(n./2))=Y(2:ceil(n./2))-2.*M(n-1:-1:floor(n./2)+1,n);
    end
end
```

Figure 10:
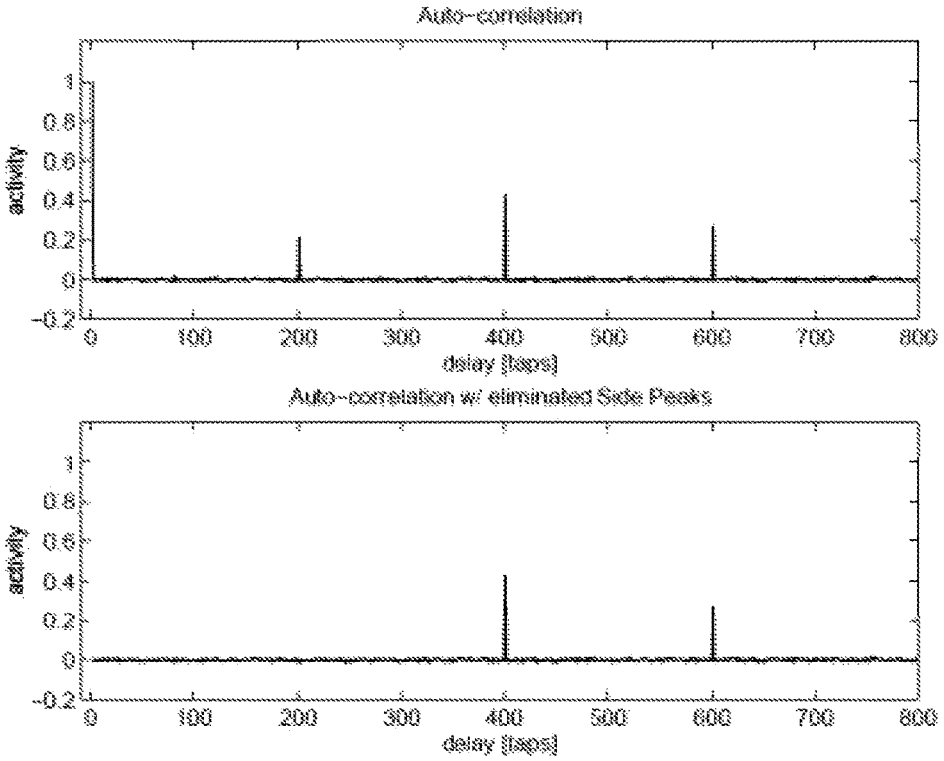
FIG. 10 depicts the performance of an algorithm that eliminates side channels that result from correlating one reflection with another according to embodiments.

FIG. 10 shows the performance of the algorithm. The top panel shows the right side of the autocorrelation function for a single-channel direct signal and two reflections (amplitudes of 0.8 and 0.5 of the direct signal at delays of 400 and 600 taps). The bottom panels show the same autocorrelation function, but with the cross-term peak removed. Note that the amplitude of the cross-term peak has to be estimated and cannot be measured analytically. Theoretically, the amplitude could be estimated using the method described in above, but then the cross-term can no longer be eliminated before determining the ITDs and ILDs. Instead of determining the delay between distinct peaks of the reflection and the main peak in the ipsilateral and contralateral channels directly using Eqs. 4 and 5, a cross-correlation algorithm may be used to achieve this.

Figure 11:
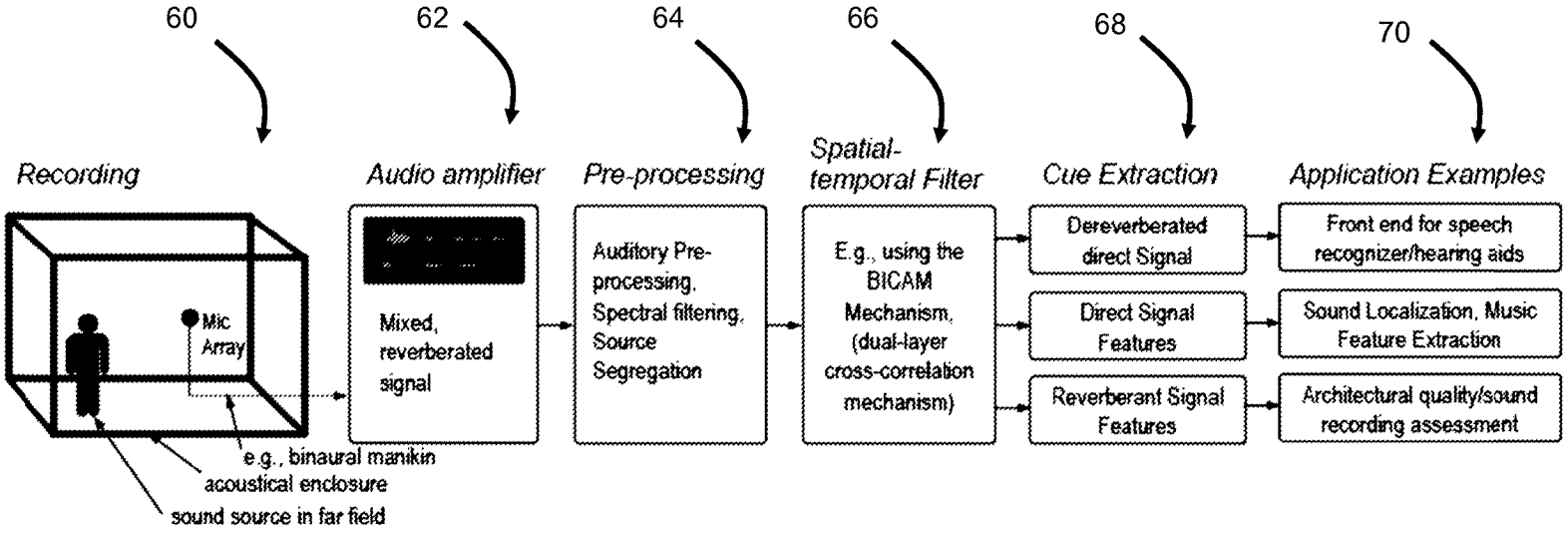
FIG. 11 depicts a system employing the BICAM process according to embodiments.

An illustrative example of a complete system is shown in FIG. 11. Initially, at 60, binaural audio data is recorded and captured in an acoustical enclosure (i.e., spatial sound field). An audio amplifier is used at 62 to input the binaural audio data and at 64 any necessary preprocessing, e.g., filtering, etc., is done. At 66, the BICAM process 45 is applied to the binaural audio data and at 66, sound cues or features are extracted, e.g., dereverberated direct signals, direct signal features, reverberated signal features, etc. Finally, at 70, the sound cues can be inputted into an associated application, e.g., a front end speech recognizer or hearing aid, a sound localization or music feature extraction system, an architectural quality/sound recording assessment system, etc.

Figure 12:
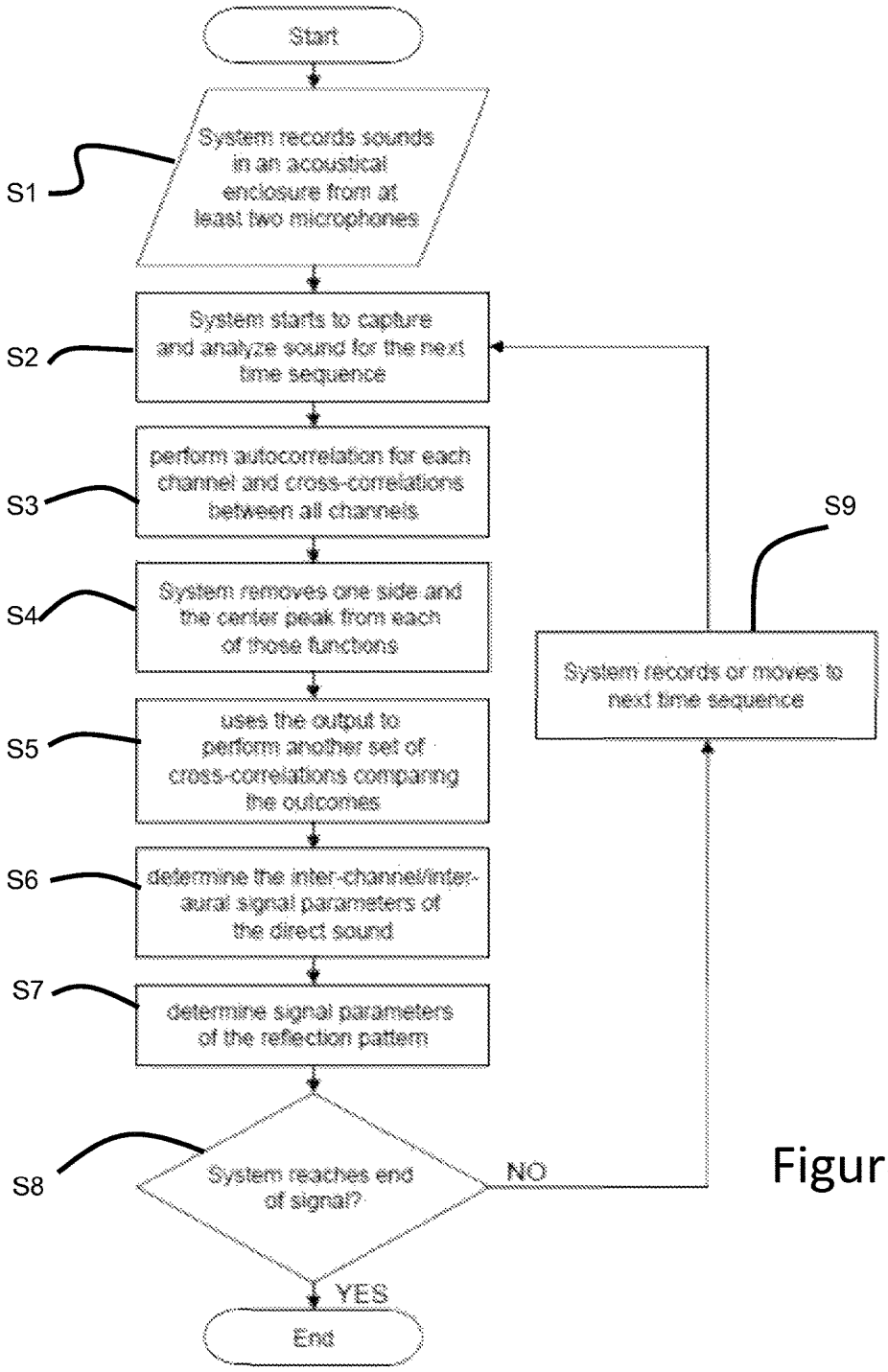
FIG. 12 depicts a flow chart that provides an overview of the BICAM process according to embodiments.

FIG. 12 depicts a flow chart that provides an overview of a BICAM process 45. At S1, the binaural sound processing system 16 (FIG. 1) records sounds in the spatial sound field 34 from at least two microphones. At S2, system 16 starts to capture and analyze sound for a next time sequence (e.g., for a 5 second sample). At S3, autocorrelation is performed for each channel of the audio signal and cross-correlations are performed between the channels. At S4, one side and the center peak from each of the previous functions is removed and at S5, the output is used to perform another set of cross-correlations that compares the outcomes. At S6, the interchannel/inter aural signal parameters of the direct sound are determined and at S7, the signal parameters of the reflection pattern are determined. At S8, a determination is made whether the end of the signal has been reached. If yes, the process ends, and if not the system records or moves to the next time sequence at S9.

This system uses a spatial-temporal filter to separate auditory features for the direct and reverberant signal parts of a running signal. A running signal is defined as a signal that is quasi-stationary over a duration that is on the order of the duration of the reverberation tail (e.g., a speech vowel, music) and does not include brief impulse signals like shotgun sounds. Since this cross-correlation algorithm is performed on top of the combined autocorrelation/cross-correlation algorithm, this is referred to as second-layer cross-correlation. For the first layer, the following set of autocorrelation/crosscorrelation sequences are calculated:

$$R_{xx}(m)=E[x_{n+m}x^*_n] \tag{12}$$

$$R_{xy}(m)=E[x_{n+m}y^*_n] \tag{13}$$

$$R_{yx}(m)=E[y_{n+m}x^*_n] \tag{14}$$

$$R_{yy}(m)=E[y_{n+m}y^*_n], \tag{15}$$

with cross-correlation sequence R and the expected value operator E{ . . . }. The variable x is the left ear signal and y is the right ear signal. The variable m is the internal delay ranging from −M to M, and n is the discrete time coefficient. Practically, the value of M needs to be equal or greater the duration of the reflection pattern of interest. The variable M can include the whole impulse response or a subset of it. Practically, values between 10 ms and 40 ms worked well. At a sampling rate of 48 kHz, M is then 480 or 1920 coefficients (taps). The variable n covers the range from 0 to the signal duration N. The calculation can be performed as a running analysis over shorter segments.

Next, the process follows a second-level cross-correlation analysis of the autocorrelation in one channel and the cross-correlation with the opposite channel. The approach is to compare side peaks of both functions (autocorrelation function and cross-correlation function). These are correlated to each other, and by aligning them in time, the offset is known between both main peaks to determine its ITD and therefore the ITD of the direct sound. The method works if the cross terms (correlations between the reflections) are within certain limits. To make this work the main peak at tau=0 has to be windowed out or set to zero, and the left side of the autocorrelation/crosscorrelation functions has to be either removed or set to zero. The variable w is the length of the window to remove the main peak by setting the coefficients smaller than w to zero. For this application a value of, e.g., 100 for w works well for w (approximately 2 ms):

$$\hat{R}_{xx}=R_{xx} \wedge \hat{R}_{xx} \stackrel{!}{=} 0 | \forall -M \leq m \leq w \tag{16}$$

$$\hat{R}_{xy}=R_{xy} \wedge \hat{R}_{xy} \stackrel{!}{=} 0 | \forall -M \leq m \leq w \tag{17}$$

$$\hat{R}_{yx}=R_{yx} \wedge \hat{R}_{yx} \stackrel{!}{=} 0 | \forall -M \leq m \leq w \tag{18}$$

$$\hat{R}_{xy}=R_{yy} \wedge \hat{R}_{yy} \stackrel{!}{=} 0 | \forall -M \leq m \leq w \tag{19}$$

Next, the second layered cross-correlation using the 'hat'-versions can be performed. The Interaural Time Difference (ITD) $k_d$ for the direct signal is then:

$$k_d = \max_m \arg\left\{ R_{\hat{R}_{xy}\hat{R}_{xx}} \right\}. \tag{20}$$

The $ITD_d$ is also calculated using the opposite channel:

$$k_{d^*} = \max_m \arg\left\{ R_{\hat{R}_{yy}\hat{R}_{yx}} \right\}. \tag{21}$$

For stability reasons, both methods can be combined and the ITD is then calculated from the product of the two second-layer cross-correlation terms:

$$k_{\hat{d}} = \max_m \arg\left\{ \sqrt{\left| R_{\hat{R}_{xy}\hat{R}_{xx}} \cdot R_{\hat{R}_{yy}\hat{R}_{yx}} \right|} \right\}. \tag{22}$$

Next, a similar calculation can be made to derive the ITD parameters for the reflection $k_r$, $k^*_r$, and $k^-_r$. Basically, the same calculation is done but in time reverse order to estimate the ITD of the reflection. This methods works well for one reflection or one dominant reflection. In cases of multiple early reflection, this might not work, even though the ITD of the direct sound can still be extracted:

$$ITD_r = \max_m \arg\left\{ R_{\hat{R}_{xx}\hat{R}_{yx}} \right\}, \tag{23}$$

And using the alternative method with the opposite channel:

$$ITD_{r^*} = \max_m \arg\left\{ R_{\hat{R}_{xy}\hat{R}_{yy}} \right\}, \tag{24}$$

and the combined method:

$$ITD_{\hat{r}} = \max_m \arg\left\{ \sqrt{\left| R_{\hat{R}_{xx}\hat{R}_{yx}} \cdot R_{\hat{R}_{xy}\hat{R}_{yy}} \right|} \right\}. \tag{25}$$

Note that the same results could be produced using the left sides of the autocorrelation/crosscorrelation sequences used to calculate $ITD_d$. The results of the analysis can be used multiple ways. The ITD of the direct signal $k_d$ can be used to localize a sound source based on the direct sound source in a similar way to human hearing (i.e., precedence effect, law of the first wave front). Using further analysis, the ILD and amplitude estimations can be incorporated. Also the cross-term elimination process explained herein can be used with the 2nd-layer correlation model. The reflection pattern can be analyzed in the following way: The ITD of the direct signal $k_d$ can be used to shift one of the two autocorrelation functions $R_{xx}$ and $R_{yy}$ representing the left and right channels:

$$\check{R}_{xx}(m)=R_{xx}(m+k_d) \tag{26}$$

$$\check{R}_{yy}(m)=R_{yy}(m), \tag{27}$$

Next, a running cross-correlation over the time aligned autocorrelation functions can be performed to estimate the parameters for the reflections. The left side of the autocorrelation functions should be removed before the analysis.

Sound Source Separation

The following discussion describes a sound source separation system 24 (FIG. 1) for separating two or more located sound sources from multichannel audio data. More specifically, the sound source separation system 24 employs a spatial sound source segregation process for separating two more sound sources that macroscopically overlap in time and frequency. In a spatial sound source segregation process, like the one proposed here, each sound source has a unique spatial position that can be used as a criterion to separate them from each other. The general method is to separate the signal for each channel into a matrix of time-frequency elements (e.g., using a filter bank or Fourier Transform to analyze the signal frequency-wise and time windows in each frequency band to analyze the signal time-wise). While multiple audio signals (e.g., competing voices) overlap macroscopically, it is assumed that they only partly overlap microscopically, such that time-frequency elements can be found in which the desired signal and the competing signals reside in isolation, thus allowing the competing signal parts to be annihilated. The desired signal is then reconstructed by adding the remaining time-frequency elements (that contain the desired signal) back together, e.g., using the overlap-add method.

The process proposed here improves existing binaural sound source segregation models (1) by using the Equalization/Cancellation (EC) method to find the elements that contain each sound source and (2) by removing the room reflections for each sound source prior to the EC analysis. The combination of (1) and (2) improves the robustness of existing algorithms especially for reverberated signals.

Figure 13:
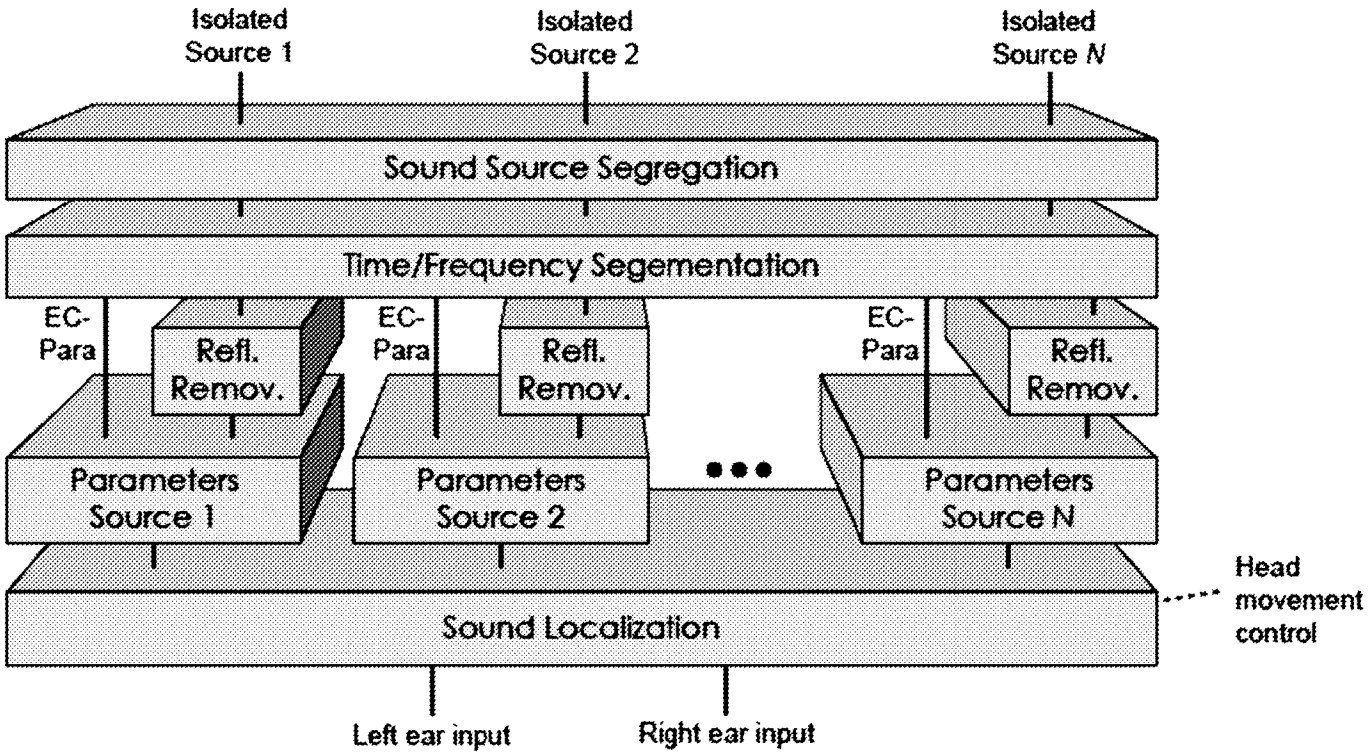
FIG. 13 depicts the extension of the BICAM process for sound separation according to embodiments.

FIG. 13 shows the extension of the BICAM process 45 (or other sound source localization model) to the implement sound source separation system 24.

To improve the performance of the sound source separation system 24 compared to current systems, a number of important stages were introduced:

1. To select the time/frequency bins that contain the signal components of the desired sound source, sound source separation system 24 utilizes Durlach's Equalization/Cancellation (EC) model instead of using the cue Selection method based on interaural coherence. Effectively, a null-antenna approach is used, that exploits the fact that the lobe of the 2-channel sensor the two ears represent is much more effective at rejecting a signal than filtering one out. This approach is also computationally more efficient. The EC model has been used successfully for sound-source segregation, but this approach is novel in that:

(a) the EC model is used in conjunction with room-impulse responses and not only anechoic signals; and (b) the BICAM process 45 is used, a much more reliable localization algorithm described herein, as a front-end that allows the processing of reverberant signals.

2. Instead of removing early reflections in every time frequency bin, each sound source is treated as an independent channel. Then:

(a) first filter out the early reflections; and (b) then use the EC model to detect the signal components that belong to this channel.

Illustrative examples described herein were created using speech stimuli from the Archimedes CD with anechoic recordings. A female and male voice were mixed together at a sampling frequency of 44.1 kHz, such that the male voice was heard for the first half second, the female voice for the second half second and both voices were concurrent during the last 1.5 seconds. The female voice said: "Infinitely many numbers can be com(posed)," while the male voice said: "As in four, score and seven". For simplicity, the female voice was spatialized to the left with an ITD of 0.45 ms, and the male voice to the right with 0:27 ms, but the model can handle measured head-related transfer functions to spatialize sound sources. In some examples, both sound sources (female and male voice) contain an early reflection. The reflection of the female voice is delayed by 1.8 ms with an ITD of −0.36 ms, and the reflection of the male voice is delayed by 2.7 ms with an ITD of 0.54 ms. The amplitude of each reflection is attenuated to 80% of the amplitude of the direct sound.

For the examples that included a reverberation tail, the tail was computed from octave-filtered Gaussian noise signals that were windowed out with an exponentially decaying windows set for individual reverberation times in each octave band. Afterwards, the octave-filtered were added together for a broadband signal. Independent noise signals were used as a basis for the left and right channels and for the two voices. In this example, the reverberation time was 1 second uniform across all frequencies with a direct to late reverberation ratio of 0 dB.

The model architecture is as follows. Basilar-membrane and hair-cell behavior are simulated with a gammatone-filter bank. The gammatone-filter bank, consists, e.g., of 36 auditory frequency bands, each one Equivalent Rectangular Bandwidth (ERB) wide.

The EC model is mainly used to explain the detection of masked signals. It assumes that the auditory system has mechanisms to cancel the influence of the masker by equalizing the left and right ear signals to the properties of the masker and then subtracting one channel from the other. Information about the target signal is obtained from what remains after the subtraction. For the equalization process, it is assumed that the masker is spatially characterized by interaural time and level differences. The two ear signals are then aligned in time and amplitude to compensate for these two interaural differences.

The model can be extended to handle variations in time and frequency across different frequency bands. Internal noise in the form of time and amplitude jitter is used to degrade the equalization process to match human performance in detecting masked signals.

Figure 14:
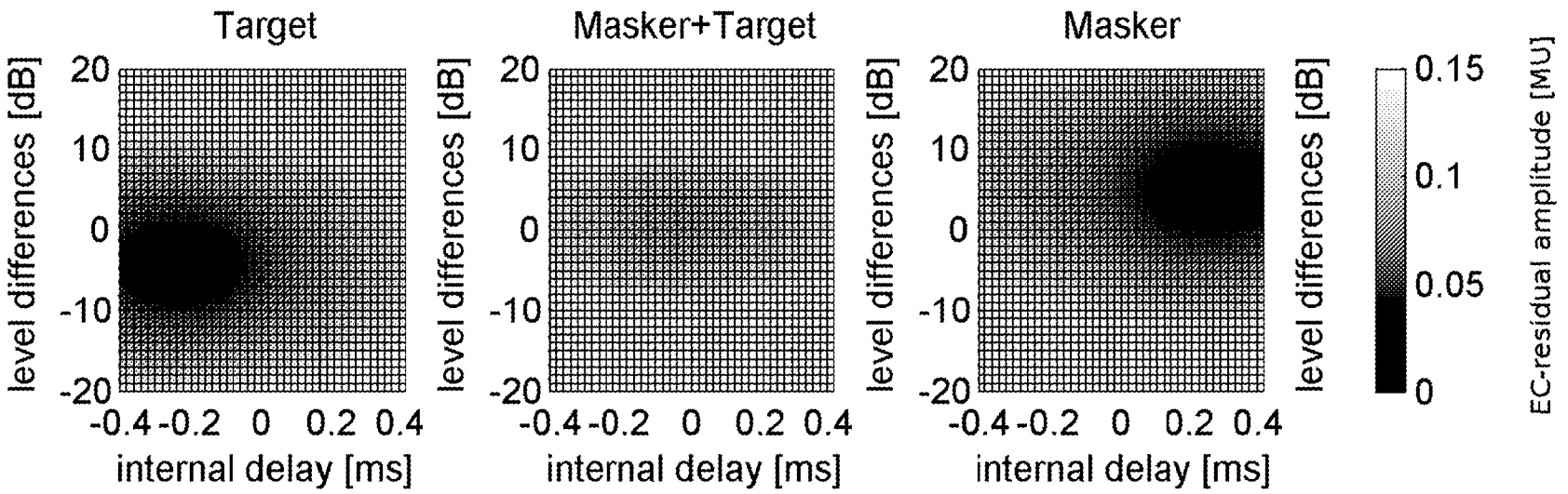
FIG. 14 depicts an example of sound source separation using the Equalization/Cancellation mechanism for an auditory band with a center frequency of 750 Hz according to embodiments.

FIG. 14 illustrates how this is achieved using the data in an auditory band with a center frequency of 750 Hz. For each graph, all possible ITD/ILD equalization parameters are calculated, and the data for each bin shows the residual of the EC amplitude after the cancellation process. A magnitude close to zero (dark color) means that the signal was successfully eliminated, because at this location the true signal values for ITD (shown in the horizontal) and ILD were found (shown in the vertical). This is only possible for the left graph, which shows the case of an isolated target and the right graph, which shows the case of the isolated masker. In case of the overlapping target and masker case, shown in the center panel, a successful cancellation process is no longer possible, because the EC model cannot simultaneously compensate for two signals with different ILD and ITD cues. As a consequence the lowest point with a value of 0.15 is no longer close to zero, and thus the magnitude of the lowest point can be used as an indicator if more than two signals are present in this time/frequency bin. The present model uses the one-signal bins and groups them according to different spatial locations, and integrates over a similar ITD/ILD combination to determine the positions of masker and target.

Figure 15:
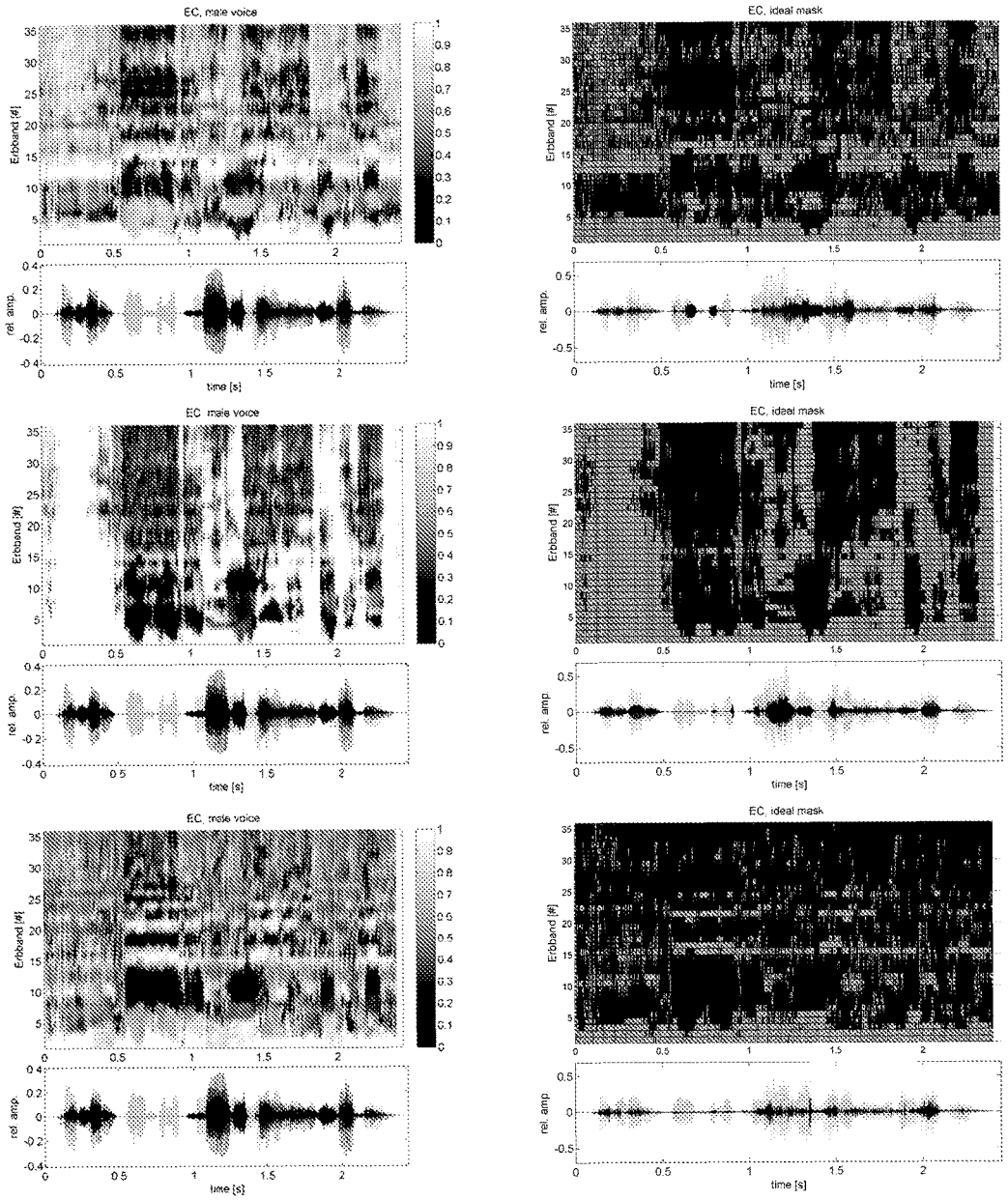
FIG. 15 shows the results for the EC-selection mechanism according to embodiments.

In the following examples, the EC model is used to determine areas in the joint time/frequency space that contain isolated target and masker components. In contrast to FIG. 14, the EC analysis for different ITD combinations is reduced and the second dimension is used for time analysis. FIG. 15 shows the results for the EC-selection mechanism.

The top left graph shows the selected cues for the male voice. For this purpose, the EC algorithm is set to compensate for the ITD of the male voice before both signals are subtracted from each other. The cue selection parameter b is estimated:

$$b(n, m) = \frac{\sqrt{\sum (x_1(n, m) - x_2(n, m))^2}}{E(n, m)}.$$

with the left and right audio signals $\mathbf{x1}(n,m)$ and $\mathbf{x2}(n,m)$, and the energy:

$$E=\sqrt{\Sigma(x1.^2+x2.^2)}.$$

The variable n is the frequency band and m is the time bin. The cue is then plotted as $$B=\max(b)-b;$$

to normalize the selection cue between 0 (not selected) and 1 (selected). In the following examples, the threshold for B was set to 0.75 to select cues. The graph shows that the selected cues correlate well with the male voice signal. While the model also accidentally selects information from the female voice, most bins corresponding to the female voice are not selected.

One of the main advantages of the EC approach compared to other methods is that cues do not have to be assigned to one of the competing sound sources, but it will come naturally to the algorithm as the EC model is targeting one direction at a time only. Theoretically, one could design the coherence algorithm to only look out for peaks for one direction, by computing the peak height for an isolated internal delay, but one has to keep in mind that the EC model's underlying null antenna has a much better spatial selectivity than the constructive beamforming approach the cross-correlation method resembles.

The top-right graph of FIG. 15 shows the binary mask that was computed from the left graph using a threshold of 0.75. The white tiles represent the selected time/frequency bins corresponding to the darker areas in the left graph. The center and bottom panels of the right graph show the time series of the total reverberant signal (center panel, male & female voices+plus reverberation), bottom panel: the isolated anechoic voice signal (grey curve) and the signal that was extracted from the mixture using the EC model (black curve). In general, the model is able to perform the task and also noticeably removes the reverberation tail.

Next, the process was analyzed to handle the removal of early reflections. For this purpose, the test stimuli were examined with early reflections as specified above, but without a late reverberation tail. As part of the source segregation process, the early reflection is removed from the total signal, prior to the EC analysis. The filter design was taken from an earlier precedence effect model. The filter takes values of the delay between the direct signal and the reflection, T, and the amplitude ratio between direct signal and reflection r, which can be estimated by the BICAM localization algorithm or alternatively by a precedence effect model. The lag-removal filter can eliminate the lag from the total signal:

$$h_d(t) = \sum_{n=0}^{N} (-r)^n \delta(t - nT).$$

This deconvolution filter $h_d$ converges quickly and only a few filter coefficients are needed to remove the lag signal effectively from the total signal. In the ideal case, the number of filter coefficients, N, approaches ∞, producing an infinite impulse response (IIR) filter that completely removes the lag from the total signal.

The filter's mode of operation is fairly intuitive. The main coefficient, δ(t−0), passes the complete signal, while the first negative filter coefficient, −rδ(t−T), is adjusted to eliminate the lag by subtracting a delayed copy of the signal. However, one has to keep in mind that the lag will also be processed through the filter, and thus the second, negative filter coefficient will evoke another signal that is delayed by 2T compared to the lead. This newly generated signal component has to be compensated by a third positive filter coefficient and so on.

FIG. 15 shows the results of the procedure for the extraction of the male voice. The top-left panel shows the test condition in which the early reflection of the male voice was not removed prior to the EC analysis. The analysis is very faulty. In particular, the signal is not correctly detected in several frequency bands, especially ERB bands 6 to 11 (220-540 Hz). At low frequencies, Bands 1 to 4, a signal is always detected, and the female voice is no longer rejected. Consequently, the binary maps contain significant errors at the specified frequencies (top right graph), and the reconstructed male-voice signal does not correlate well with the original signal (compare the curve in the sub-panel of the top-right figure to the curve in the sub-panel of the top-left figure).

The two graphs in the bottom row of FIG. 15 show the condition in which a filter was applied to the total signal to remove the early reflection for the male voice. Note that the female voice signal is also affected by the filter, but in this case the filter coefficients do not match the settings of its early reflection, because both the female and male voices have early reflection different spatial properties as would be observed in a natural condition.

Consequently, the filter will alter the female-voice signal in some way, but not systematically remove its early reflection. Since we treat this signal as background noise for now, we are not too worried about altering its properties as long as we can improve the signal characteristics of the male-voice signal. As the left graph of the center row indicates, the identification of the time/frequency bins containing the male-voice signal works much better now compared to the previous condition where no lag was removed—see FIG. 15 top-left panel. Note especially, the solid white block in the beginning, where the male-voice signal is presented in isolation. This translates into a much more accurate binary map as shown in the right graph of the center row. It is important to note that the application of the lag-removal filter with male-voice settings does not prevent the correct rejection of the female-voice signal. Only in a very few instances is a time-frequency bin selected in the female voice-only region (0.5-1.0 seconds).

The process now also does a much better job in extracting the male voice signal from the mixture (1.0-2.5 seconds) than when no lag-removal filter was applied (compare top-right graph of the same figure). Now, we will examine the model performance if the lag-removal settings are taken that is optimal to remove the early reflection for the female-voice signal. As expected, the model algorithm no longer works well, because the EC analysis is set to extract the male voice, while the lag removal filter is applied to remove the early reflection of the female voice. The two bottom graphs of FIG. 15 show that the correctly identified time/frequency bins are very scattered, and in many frequency bins, no signal is detected.

Figure 16:
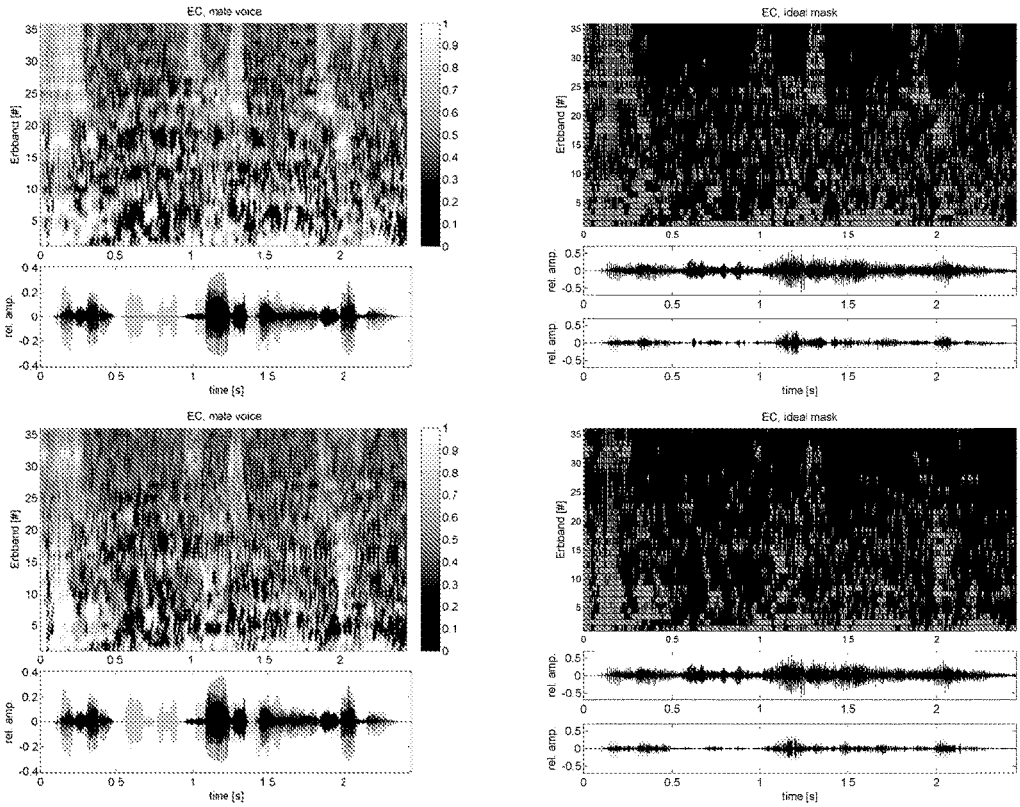
FIG. 16 shows an illustrative case in which a male voice is extracted using sound separation according to embodiments.

The next step was to analyze the test condition in which the both early reflections and late reverberation was added to the signal. FIG. 16 shows the case in which the male voice was extracted. The two top panels show the case, where the early reflection where not removed prior to the EC model analysis. The EC model misses a lot of mid-frequency bins between ERB bands 8 and 16. Note for example the first onset at 0.2 s, where the cues are no longer close to one (left panel), and therefore the corresponding time/frequency are not selected (right panel). The two bottom panels show the condition, where the early reflection corresponding to the male voice was removed. Note that now the mid-frequency bins are selected again as both the w areas in the left panel and the white areas in the right panel reappear. When listening to the signal, one can tell that the delay has been removed and the voice sounds much cleaner.

The sound source localization and segregation processing can be performed iteratively, such that a small segment of sound (e.g., 10 ms) is used to determine the spatial positions of sound sources and reflections and then a the sound source segregation algorithm is perform over the same small sample (the temporally following one) to remove the reflections and desired sound sources, to obtain a more accurate calculation of the sound source positions and isolation of the desired sound sources. The information from both processes (localization and segregation) is then used to analyze the next time window. The iterative process is also needed for cases where the sound sources change their spatial location over time.

Referring again to FIG. 1, aspects of the sound processing system 18 may be implemented on one or more computing systems, e.g., with a computer program product stored on a computer readable storage medium. The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Java, Python, Smalltalk, C++ or the like, and conventional procedural programming languages, such as the "C" programming language or similar programming languages. The computer readable program instructions may execute entirely on the computer, partly on the computer, as a stand-alone software package, partly on the computer and partly on a remote device or entirely on the remote device or server. In the latter scenario, the remote device may be connected to the computer through any type of network, including wireless, a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Computer system 10 for implementing binaural sound processing system 18 may comprise any type of computing device and, and for example include at least one processor, memory, an input/output (I/O) (e.g., one or more I/O interfaces and/or devices), and a communications pathway. In general, processor(s) execute program code which is at least partially fixed in memory. While executing program code, the processor(s) can process data, which can result in reading and/or writing transformed data from/to memory and/or I/O for further processing. The pathway provides a communications link between each of the components in computing system. I/O can comprise one or more human I/O devices, which enable a user or other system to interact with computing system. The described repositories may be implementing with any type of data storage, e.g., databases, file systems, tables, etc.

Furthermore, it is understood that binaural sound processing system 18 or relevant components thereof (such as an API component) may also be automatically or semi-automatically deployed into a computer system by sending the components to a central server or a group of central servers. The components are then downloaded into a target computer that will execute the components. The components are then either detached to a directory or loaded into a directory that executes a program that detaches the components into a directory. Another alternative is to send the components directly to a directory on a client computer hard drive. When there are proxy servers, the process will, select the proxy server code, determine on which computers to place the proxy servers' code, transmit the proxy server code, then install the proxy server code on the proxy computer. The components will be transmitted to the proxy server and then it will be stored on the proxy server.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to an individual in the art are included within the scope of the invention as defined by the accompanying claims.

The invention claimed is:

1. A sound processing system for estimating parameters from binaural audio data, comprising:

a system for inputting binaural audio data having a first channel and a second channel captured from a spatial sound field using at least two microphones;

a binaural signal analyzer including a mechanism that:

performs an autocorrelation on both the first channel and second channel to generate a pair of autocorrelation functions;

performs a first layer cross-correlation between the first channel and second channel to generate a first layer cross-correlation function;

removes the center peak from the first layer cross-correlation function and a selected autocorrelation function to create a modified pair;

performs a second layer cross-correlation between the modified pair to determine a temporal mismatch;

generates a resulting function by replacing the first layer cross correlation function with the selected autocorrelation function using the temporal mismatch such that the center peak of the selected autocorrelation function matches the temporal position of the center peak of the first layer cross correlation function; and utilizes the resulting function to determine interaural time difference (ITD) parameters and interaural level difference (ILD) parameters of direct sound components and reflected sound components; and a sound localization system that determines position information of the direct sound components using the ITD and ILD parameters.

2. The system of claim 1, wherein removal of the center peak further includes removal of a side of the first layer cross-correlation function and selected autocorrelation function.

3. The system of claim 1, wherein a running cross-correlation is utilized for the second layer cross-correlation.

4. The system of claim 3, wherein the running cross-correlation is utilized to determine acoustical parameters of the spatial sound field.

5. The system of claim 1, further comprising a sound source separation system that segregates different sound sources within the spatial sound field using the determined ITD and ILD parameters.

6. The system of claim 5, wherein the sound source separation system includes:

a system for removing sound reflections for each sound source; and a system for employing an equalization/cancellation (EC) process to identify a set of elements that contain each sound source.

7. A computerized method for estimating parameters from binaural audio data having a first channel and a second channel captured from a spatial sound field using at least two microphones, comprising:

performing an autocorrelation on both the first channel and second channel to generate a pair of autocorrelation functions;

performing a first layer cross-correlation between the first channel and second channel to generate a first layer cross-correlation function;

removing the center peak from the first layer cross-correlation function and a selected autocorrelation function to create a modified pair;

performing a second layer cross-correlation between the modified pair to determine a temporal mismatch;

generating a resulting function by replacing the first layer cross correlation function with the selected autocorrelation function using the temporal mismatch such that the center peak of the selected autocorrelation function matches the temporal position of the center peak of the first layer cross correlation function;

utilizing the resulting function to determine interaural time difference (ITD) parameters and interaural level difference (ILD) parameters of direct sound components and reflected sound components; and segregating different sound sources within the spatial sound field using the ITD and ILD parameters.

8. The computerized method of claim 7, wherein removal of the center peak further includes removal of a side of the first layer cross-correlation function and selected autocorrelation function.

9. The computerized method of claim 7, further comprising determining position information of the direct sound components using the ITD and ILD parameters.

10. The computerized method of claim 7, wherein a running cross-correlation is utilized for the second layer cross-correlation.

11. The computerized method of claim 10, wherein the running cross-correlation is utilized to determine acoustical parameters of the spatial sound field.

12. The computerized method of claim 7, wherein the segregating includes:

removing sound reflections for each sound source; and employing an equalization/cancellation (EC) process to identify a set of elements that contain each sound source.

13. A computer program product stored on a non-transitory computer readable medium, which when executed by a computing system estimates parameters from binaural audio data having a first channel and a second channel captured from a spatial sound field using at least two microphones, the program product comprising:

program code for performing an autocorrelation on both the first channel and second channel to generate a pair of autocorrelation functions;

program code for performing a first layer cross-correlation between the first channel and second channel to generate a first layer cross-correlation function;

program code for removing the center peak from the first layer cross-correlation function and a selected autocorrelation function to create a modified pair;

program code for performing a second layer cross-correlation between the modified pair to determine a temporal mismatch;

program code for generating a resulting function by replacing the first layer cross correlation function with the selected autocorrelation function using the temporal mismatch such that the center peak of the selected autocorrelation function matches the temporal position of the center peak of the first layer cross correlation function;

program code for utilizing the resulting function to determine interaural time difference (ITD) parameters and interaural level difference (ILD) parameters of direct sound components and reflected sound components; and program code for segregating different sound sources within the spatial sound field using the ITD and ILD parameters.

14. The program product of claim 13, wherein removal of the center peak further includes removal of a side of the first layer cross-correlation function and selected autocorrelation function.

15. The program product of claim 13, further comprising program code for determining position information of the direct sound components using the ITD and ILD parameters.

16. The program product of claim 13, wherein a running cross-correlation is utilized for the second layer cross-correlation to determine acoustical parameters of the spatial sound field.

17. The program product of claim 13, wherein the program code for segregating includes:

program code for removing sound reflections for each sound source; and program code for employing an equalization/cancellation (EC) process to identify a set of elements that contain each sound source.

18. A sound processing system for estimating parameters from binaural audio data, comprising:

a system for inputting binaural audio data having a first channel and a second channel captured from a spatial sound field using at least two microphones; and a binaural signal analyzer for separating direct sound components from reflected sound components by identifying a center peak and at least one peak included in the binaural audio data of the first channel and the second channel, wherein the binaural signal analyzer includes a mechanism that:

performs an autocorrelation on both the first channel and second channel to generate a pair of autocorrelation functions;

performs a first layer cross-correlation between the first channel and second channel to generate a first layer cross-correlation function;

removes the center peak from the first layer cross-correlation function and a selected autocorrelation function to create a modified pair;

performs a second layer cross-correlation between the modified pair to determine a temporal mismatch;

generates a resulting function by replacing the first layer cross correlation function with the selected autocorrelation function using the temporal mismatch such that the center peak of the selected autocorrelation function matches the temporal position of the center peak of the first layer cross correlation function; and utilizes the resulting function to determine interaural time difference (ITD) parameters and interaural level difference (ILD) parameters of the direct sound components and reflected sound components.

* * * * *